US008586844B2

(12) United States Patent
Swenney

(10) Patent No.: US 8,586,844 B2
(45) Date of Patent: Nov. 19, 2013

(54) UNDER BRIDGE SYSTEM FOR GUITARS

(76) Inventor: Thomas Edward Swenney, Metropolis, IL (US)

( * ) Notice: Subject to any disclaimer, the term of this patent is extended or adjusted under 35 U.S.C. 154(b) by 204 days.

(21) Appl. No.: 13/290,810

(22) Filed: Nov. 7, 2011

(65) Prior Publication Data

US 2012/0186414 A1 Jul. 26, 2012

Related U.S. Application Data

(60) Provisional application No. 61/436,038, filed on Jan. 25, 2011.

(51) Int. Cl.
*G10D 3/04* (2006.01)

(52) U.S. Cl.
USPC ..... 84/307

(58) Field of Classification Search
USPC ..... 84/307; D17/20, 21
See application file for complete search history.

(56) References Cited

U.S. PATENT DOCUMENTS

| | | | | |
|---|---|---|---|---|
| 4,291,607 | A * | 9/1981 | Kauffman | 84/299 |
| 4,433,605 | A * | 2/1984 | Matsui | 84/299 |
| 6,534,697 | B1 * | 3/2003 | Ko | 84/299 |
| 8,203,059 | B2 * | 6/2012 | Miloslavsky | 84/291 |
| 2007/0012159 | A1 * | 1/2007 | Babicz | 84/307 |

* cited by examiner

*Primary Examiner* — Jianchun Qin

(57) ABSTRACT

An under bridge system is provided having a bridge designed to be secured under the top surface of a guitar and at least one female threaded insert in a top surface of the bridge. The bridge may be adapted to be operationally connected to a saddle on the top surface of the guitar. Each of the at least one threaded inserts is coupled with male threads of a corresponding stud extending downward from the bottom of the saddle through the top surface of the guitar. Each stud is turnable to adjust the height of the saddle above the top surface of the guitar.

9 Claims, 3 Drawing Sheets

UNDER BRIDGE SYSTEM FOR GUITARS

CROSS-REFERENCE TO RELATED APPLICATION

The present application is a non-provisional application claiming the benefit of priority of U.S. Provisional Application Ser. No. 61/436,038, entitled UNDER BRIDGE SYSTEM FOR GUITARS, filed on Jan. 25, 2011, which application is incorporated herein by reference in its entirety.

BACKGROUND OF THE INVENTION

The present invention generally relates to guitars and, in particular, to an under bridge system for guitars.

Arch-type and electric guitars may have a saddle mounted to, and supported by, a bridge. The saddle supports the strings and transfers the string vibrations through the bridge to the top surface of the guitar and into the air of the hollow body. For the proper use of a vibrator tailpiece, the strings should be at a particular height above the guitar surface. However, on a flattop guitar, a bridge-mounted saddle will raise the strings too high for a vibrator tailpiece to be used.

As can be seen, a saddle may not raise the strings to the correct height for a tailpiece to be used with a flattop guitar.

SUMMARY OF THE INVENTION

In one aspect of the present invention, an under bridge system is provided having a bridge designed to be secured under the top surface of a guitar and adapted to be operationally connected to a saddle on the top surface of the guitar. The under bridge system further includes at least one female threaded insert in the top surface of the bridge. Each of the at least one threaded inserts is coupled with male threads of a corresponding stud extending downward from the bottom of the saddle through the top surface of the guitar and each stud is turnable to adjust the height of the saddle above the top surface of the guitar.

In another aspect of the present invention, a method of constructing an under bridge system is provided. The method comprises providing a block member, securing the bridge under the top surface of a guitar, and operationally connecting the bridge to a saddle on the top surface of the guitar.

In still another aspect of the present invention, an under bridge system is provided comprising a bridge designed to be secured under a top surface of the guitar, at least one female threaded insert in a top surface of the bridge, and a saddle designed to be mounted to the top surface of a guitar. The saddle comprises a plurality of rollers, designed to be in contact with strings of the guitar, and at least one threaded stud extending downward from a bottom of the saddle through the top surface of the guitar. Each threaded stud is coupled to a corresponding one of the at least one threaded insert in the top surface of the bridge, the threaded studs being turnable to adjust the height of the rollers relative to the top surface of the guitar.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Various inventive features are described below that can each be used independently of one another or in combination with other features.

Broadly, an embodiment of the present invention generally provides an under bridge system for a guitar, such as a flattop acoustic guitar. Embodiments of the under bridge system may allow a saddle, such as a roller saddle, to be mounted such that the strings of the guitar are positioned at the desired height for use with, for example, a vibrato tailpiece.

Figure 1:
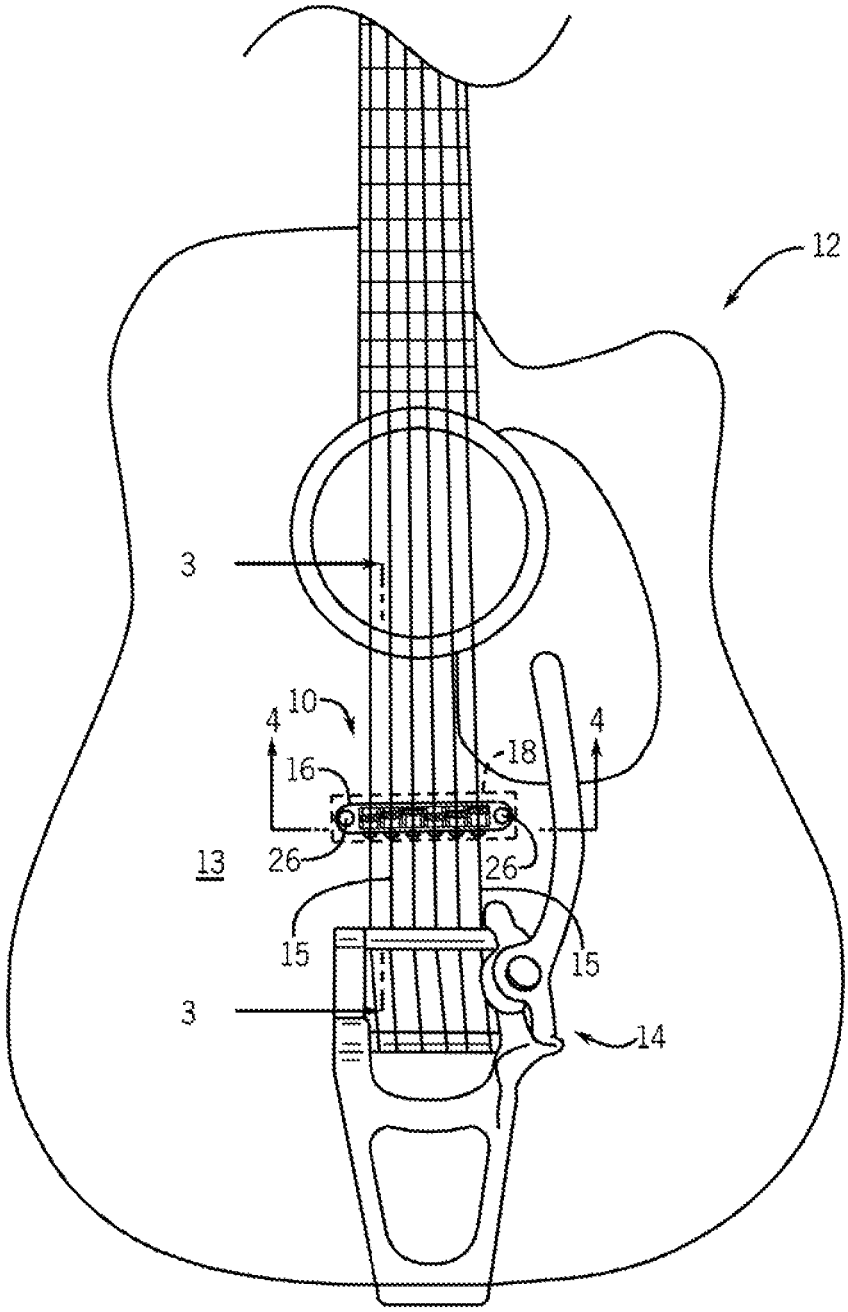
FIG. 1 is a plan view of an under bridge system according to one embodiment of the present invention installed on a guitar.
Figure 2:
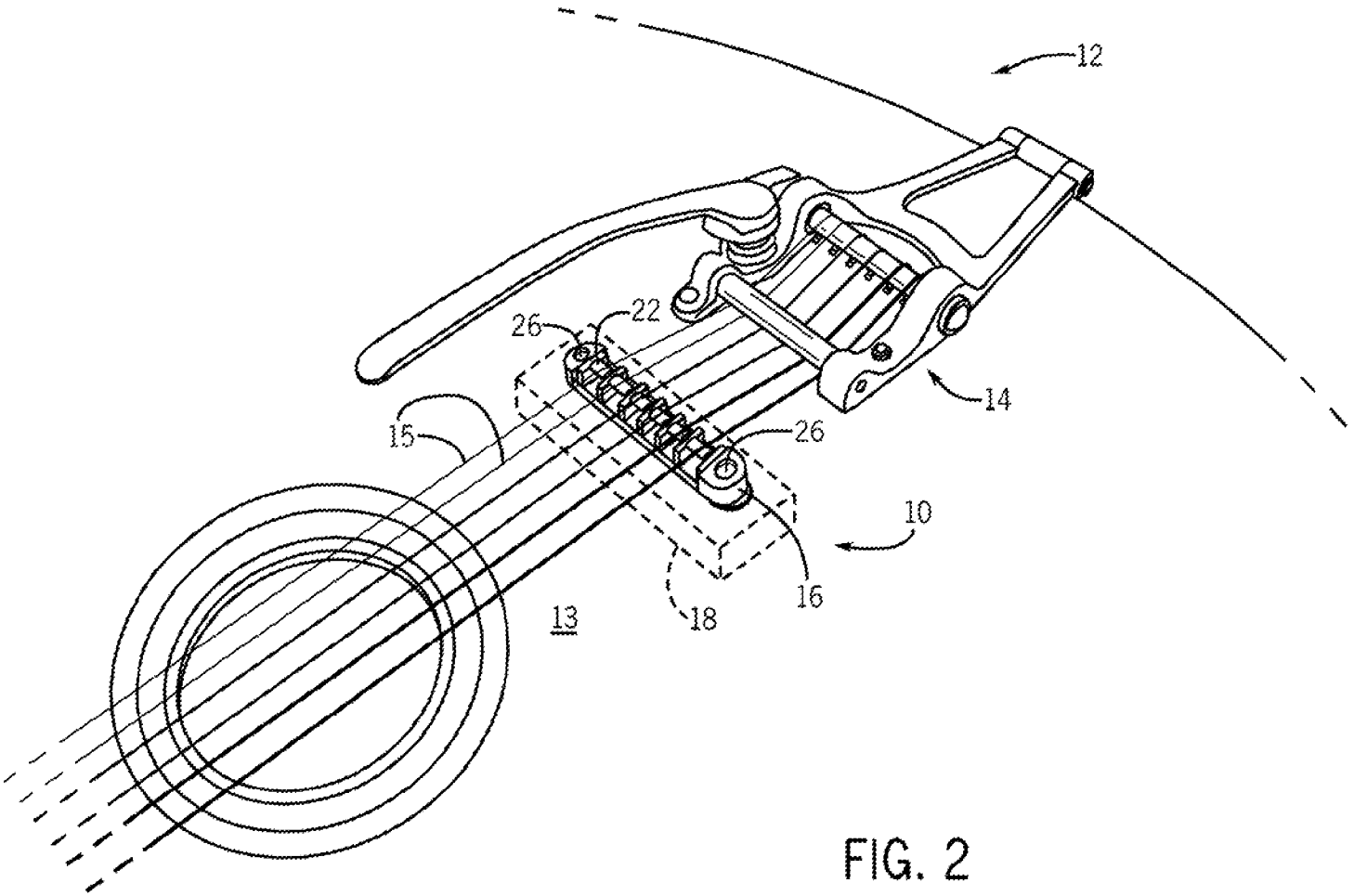
FIG. 2 is a perspective view of the under bridge system of FIG. 1.
Figure 3:
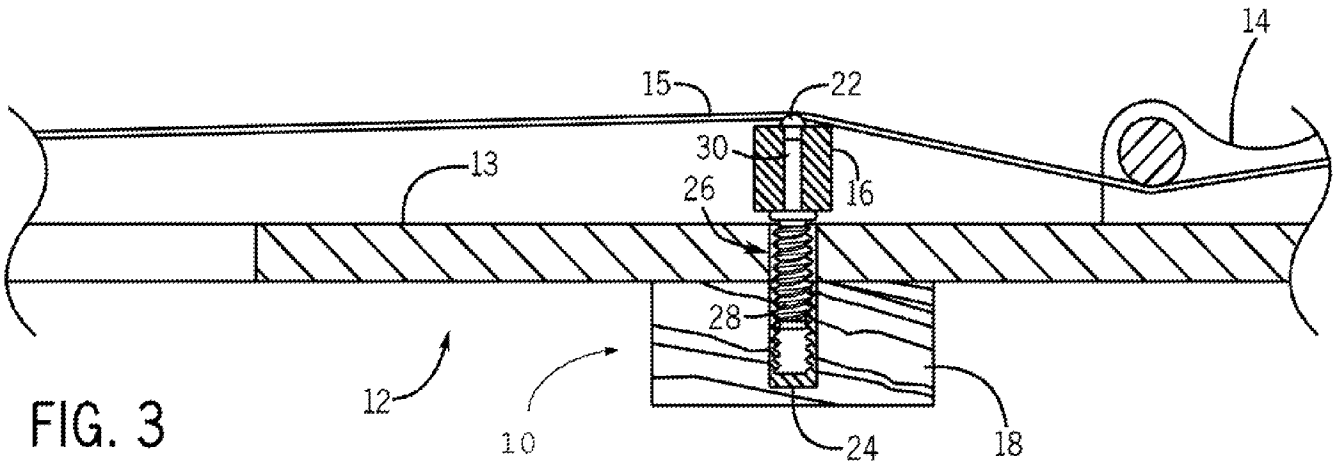
FIG. 3 is a view through line 3-3 of FIG. 1.
Figure 4:
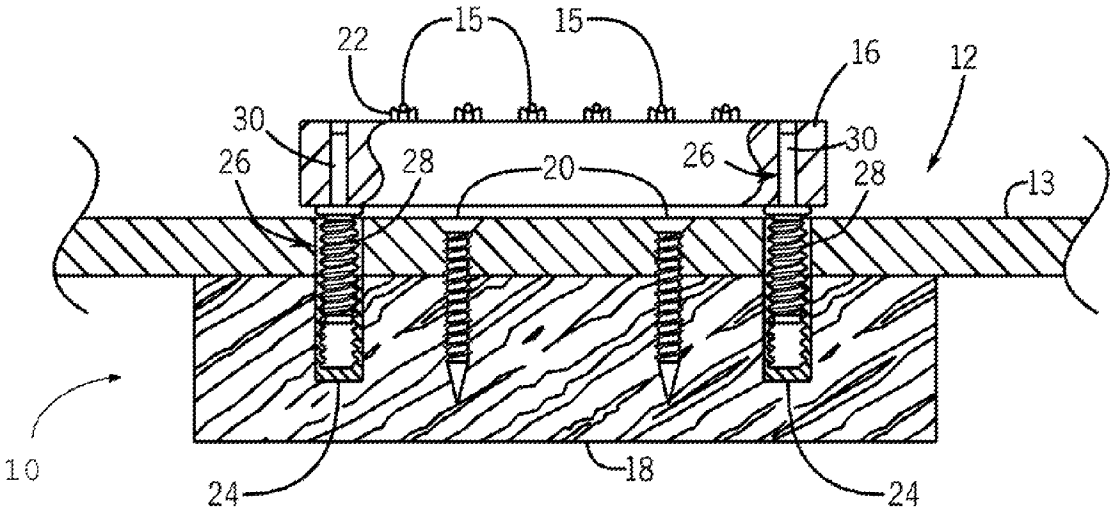
FIG. 4 is a view through line 4-4 of FIG. 1.

An under bridge system 10 according to an embodiment of the present invention installed on a guitar 12 is shown in FIGS. 1-4. The guitar 12 may comprise a flattop acoustic guitar having a top surface 13 and a plurality of strings 15. The guitar 12 also may include a vibrato tailpiece 14.

The under bridge system 10 may include a saddle 16, such as a roller saddle with a plurality of rollers 22 designed to be in contact with the strings 15. The rollers 22 may allow the strings 15 to move when the vibrato tailpiece 14 is being used. The saddle 16 may also include at least one stud 26 having male threads 28 extending downward from the bottom of the saddle 16 and a post 30 extending upward from the top of the saddle 16.

The under bridge system 10 may further include a bridge 18 and at least one female threaded insert 24 in the top surface of the bridge. The bridge 18 may comprise a block-shaped structure, such as a block of wood, and may be about ¾ inches thick. The bridge 18 may be positioned with its top surface in contact with, and secured to, the underside of the top surface 13 of the guitar 12. For some embodiments, an adhesive (not shown) may be used to glue the bridge 18 under the top surface of the guitar 12. For some other embodiments, screws 20 may be used to secure the bridge to the underside of the top surface 13 of the guitar 12.

The bridge 18 may be designed to be operationally connected to the saddle 16. At least one hole may be drilled through the top surface of the guitar 12 sufficiently large to allow the threaded studs 26 to pass through. The top surface of the bridge 18 may be drilled to receive the female threaded inserts 24. Each of the female threaded inserts 24 may couple with the threads 28 of a corresponding stud 26 during installation of the saddle 16, thereby operationally connecting the saddle 16 to the bridge 18. When the under bridge system 10 and the saddle 16 have been installed on the guitar 12, the studs 26 may be turned in the inserts 24, such as with a screwdriver or wrench, to adjust the height of the saddle 16, and therefore the rollers 22 and the strings, relative to the top surface 13 of the guitar 12. The studs 26 may be turned until the strings 15 are at the desired height for use with the vibrato tailpiece 14.

It should be understood, of course, that the foregoing relates to exemplary embodiments of the invention and that modifications may be made without departing from the spirit and scope of the invention as set forth in the following claims.

What is claimed is:

1. An under bridge system, comprising:

a bridge designed to be secured under a top surface of a guitar and adapted to be operationally connected to a saddle on the top surface of the guitar; and at least one female threaded insert in a top surface of the bridge, each of the at least one threaded inserts being coupled with male threads of a corresponding stud extending downward from the bottom of the saddle through the top surface of the guitar, each stud being turnable to adjust the height of the saddle above the top surface of the guitar.

2. The under bridge system of claim 1, wherein the bridge is secured under the top surface of the guitar with at least one screw.

3. The under bridge system of claim 1, wherein the bridge is secured under the top surface of the guitar with an adhesive.

4. The under bridge system of claim 1, the bridge comprising a block of wood.

5. A method of constructing an under bridge system, comprising:

providing a bridge;

securing the bridge under the top surface of a guitar; and operationally connecting the bridge to a saddle on the top surface of the guitar by coupling a threaded stud, extending downward from the bottom of the saddle mounted on the top surface of the guitar through the top surface of the guitar, into a female threaded insert in a top surface of the bridge, the threaded stud designed to adjust the height of the saddle relative to the top surface of the guitar.

6. The method of claim 5, further comprising securing the bridge under the top surface of the guitar with at least one screw.

7. The method of claim 5, further comprising securing the bridge under the top surface of the guitar with an adhesive.

8. An under bridge system, comprising:

a bridge designed to be secured under a top surface of a guitar;

at least one female threaded insert in a top surface of the bridge; and a saddle designed to be mounted to the top surface of the guitar, the saddle comprising:

a plurality of rollers designed to be in contact with strings of the guitar; and at least one threaded stud extending downward from a bottom of the saddle through the top surface of the guitar, each threaded stud being coupled to a corresponding one of the at least one threaded insert in the top surface of the bridge, the threaded studs being turnable to adjust the height of the rollers relative to the top surface of the guitar.

9. The under bridge system of claim 8, the bridge comprising a block of wood.

* * * * *